United States Patent [19]

Pfeiffer et al.

[11] 4,220,617

[45] Sep. 2, 1980

[54] PROCESS FOR MELT-SPINNING ACRYLONITRILE POLYMER FIBER

[75] Inventors: Ronald E. Pfeiffer, Pensacola; Stanley E. Peacher, Milton, both of Fla.

[73] Assignee: American Cyanamid Co., Stamford, Conn.

[21] Appl. No.: 938,197

[22] Filed: Aug. 30, 1978

[51] Int. Cl.[2] ..... D01F 6/18

[52] U.S. Cl. ..... 264/206; 264/210.3; 425/72 S; 425/464

[58] Field of Search ..... 264/206, 177 F, 210.3; 425/71, 464, 72 S

[56] References Cited

U.S. PATENT DOCUMENTS

| | | | |
|---|---|---|---|
| 2,465,408 | 3/1949 | Webb et al. | 18/8 |
| 3,621,088 | 11/1971 | Hatcher et al. | 425/71 |
| 4,163,770 | 8/1979 | Povosoff | 264/206 |

FOREIGN PATENT DOCUMENTS

| | | | |
|---|---|---|---|
| 2403947 | 8/1974 | Fed. Rep. of Germany | 264/206 |
| 43-26354 | 11/1968 | Japan | 264/206 |
| 45-3289 | 2/1970 | Japan | 425/464 |

*Primary Examiner*—Jay H. Woo

*Attorney, Agent, or Firm*—William J. Van Loo

[57] ABSTRACT

Melt-spinning of a fusion melt of an acrylonitrile polymer and water through a crowded hole spinnerette plate having small orifice diameters is achieved using low molecular weight polymer to provide fiber of desirable physical properties.

3 Claims, No Drawings

PROCESS FOR MELT-SPINNING ACRYLONITRILE POLYMER FIBER

This invention relates to a process for melt-spinning fiber-forming polymers at an increased production rate per spinnerette. More particularly, this invention relates to such a process wherein a spinnerette with a greater number of smaller orifices per given area is employed.

In conventional melt-spinning of fibers, a fiber-forming polymer is heated to a temperature at which it melts, is extruded through a spinnerette plate to form filaments which rapidly cool to become solid, and the resulting filaments are then further processed to provide the desired fiber. The spinnerette plate that is employed in such processing must contain capillaries to provide the desired filaments while satisfying two additional requirements. The capillaries must be of such dimensions as to satisfy back-pressure requirements and must be sufficiently spaced from one another as to prevent premature contact between the emerging fibers that would result in sticking together or fusion of filaments with one another. To satisfy the back-pressure requirements, the capillaries are provided with counterbores of sufficient diameter and depth.

Recent developments in the field of fiber spinning, especially acrylic fibers, has led to the development of fusion melts which can be extruded through a spinnerette plate to provide filaments. These fusion melts comprise a homogeneous composition of a fiber-forming polymer and a melt assistant therefor. The melt assistant is a material which enables the polymer to form a melt at a temperature below which the polymer would normally melt or decompose and becomes intimately associated with the molten polymer so that a single phase melt results. The melt assistant must be used in proper proportions with the polymer to provide the single-phase fusion melt. If a low boiling melt assistant is used the melt assistant in proper amounts and the polymer often must be heated at pressures above atmospheric pressure to provide the fusion melt. Since the temperature at which the fusion melt forms is above the boiling point of the melt assistant at atmospheric pressure, consequently super-atmospheric pressures are necessary to keep the melt assistant in the system. Such fusion melts have been effectively spun into fiber using spinnerette plates similar to those employed in conventional melt-spinning.

Because of the requirement for adequate spacing of the capillaries in spinnerette plates used for melt-spinning to prevent premature contact between the nascent filaments which would result in their sticking together, the number of capillaries that can be provided in a given spinnerette plate is greatly restricted. As a result, production capacity of a spinnerette with a given surface area is limited and usually large tow bundles can only be produced by combining the outputs from a series of spinnerettes. This, in turn, requires costly installations of additional spinnerettes, specially designed conduits and spin packs to ensure an even distribution of the melt to all spinning holes, provision of space for installation, and further power consumption to operate the increased number of spinnerettes.

There exists, therefore, the need for processes for providing fiber by melt spinning which enables the productivity of spinnerettes to be increased. Such provision would fulfill a long-felt need and constitute a significant advance in the art.

In accordance with the present invention, there is provided a process for melt-spinning acrylonitrile polymer fiber which comprises providing a homogeneous melt of an acrylonitrile fiber-forming polymer of kinematic molecular weight in the range of about 30,000 to 60,000 and water at a temperature above the boiling point of water at atmospheric pressure and at a temperature and pressure which maintains water in single phase with said polymer and extruding said fusion melt through a spinnerette assembly containing a spinnerette plate having a density of orifices of a diameter of about 60 to 160 microns of at least about 18 per square centimeter directly into a steam-pressurized solidification zone maintained under conditions such that the release of water from the nascent extrudate avoids deformation thereof.

The process of the present invention provides filamentary extrudates which do not stick together as they emerge from the spinnerette orifices. Since the filaments have no tendency to stick together, the orifices of the spinnerette plate can be located closer together and more orifices can be provided in the spinnerette plate. As a result, the productivity of a spinnerette can be greatly increased without negatively affecting the quality of the resulting fiber. The present invention also employs orifices of reduced cross-section relative to those conventionally employed in melt-spinning. As a result an even greater number of orifices can be present in the spinnerette plate. In order to overcome back-pressure difficulties that would arise with the orifices of narrow cross-section, the process of the present invention employs fiber-forming polymers of lower molecular weight than conventionally employed. Unexpectedly, the fiber obtained possesses good fiber properties in spite of the low molecular weight of the fiber-forming fiber. It is believed these good fiber properties are the result of processing steps employed.

The spinnerette plate used in the process of the present invention has two distinguishing features over conventional spinnerette plates used in conventional melt-spinning processes. First, the spinnerette has a much greater density of orifices per unit area than do the conventional plates used in melt-spinning by conventional procedures. Typically, prior art melt-spinning spinnerette plates have a density of about 5-10 orifices per square centimeter. In the process of the present invention, the spinnerette plate contains at least about 18 orifices per square centimeter. Second, the conventional melt-spinning spinnerette plates have orifices of about 200-400 microns or larger diameter at their exit ends. The process of the present invention, contrary to this, uses orifices in the range of about 60-160 microns diameter at their exit ends. This provision not only allows a greater number of orifices to be positioned in the spinnerette plate to increase productivity but also enables finer denier fiber to be provided at a given stretch ratio.

In carrying out the process of the present invention, it is necessary to provide a homogeneous fusion melt of a fiber-forming acrylonitrile polymer and water. Any fiber-forming acrylonitrile polymer of the specified molecular weight range that can form a fusion melt with water at a temperature above the boiling point of water at atmospheric pressure and at a pressure and temperature sufficient to maintain water and the the polymer in a single, fluid phase can be used in the process of the present invention. Polymers falling into this category are known in the art. The fusion melt is prepared at a temperature above the boiling point at atmospheric pressure of water and eventually reaches a temperature and pressure sufficient to maintain water and the polymer in a single, fluid phase.

The homogeneous fusion melt is extruded through the spinnerette plate of high orifice density and reduced orifice diameter directly into a steam-pressurized solidification zone maintained under conditions such that the rate of release of water from the nascent extrudate avoids deformation thereof. By controlling the release of water from the nascent extrudate, such deformations thereof as foamed structure, inflated structure, pockmarked structure, and the like which adversely affect processability are avoided and continuous processing can be effected in spite of the high density of orifices and low diameter thereof in the spinnerette plate. The extruded filaments are also free of any tendency to stick together due to their nature. The homogeneous fusion melt is a special type of melt that requires the combination of proper amounts of water and polymer, high temperature, and superatmospheric pressure. Slight variations in these critical features leads to solidification of the polymer which in solidification form exhibits no tendency toward stickiness. The extrudate filaments are processed further according to conventional procedures to provide desirable filamentary materials which may have application in textile and other applications.

The invention is more fully illustrated in the examples which follow wherein all parts and percentages are by weight unless otherwise specified.

Kinematic average molecular weight ($M_k$) is obtained from the following relationship:

$$\mu = \frac{1}{A} \overline{M}_k$$

wherein $\mu$ is the average effluent time (t) in seconds for a solution of 1 gram of the polymer in 100 milliliters of 53 weight percent aqueous sodium thiocyanate solvent at 40° C. multiplied by the viscometer factor and A is the solution factor derived from a polymer of known molecular weight and in the present case is equal to 3,500.

EXAMPLE 1

A fusion melt of 14% water and 86% of an acrylonitrile polymer of the following composition was prepared:

| | |
|---|---|
| Acrylonitrile | 84.98 |
| Methyl methacrylate | 12.0% |
| Polyvinyl alcohol (Trademark Elvanol 71-30G) | 3.0% |
| Acrylamidomethylpropane sulfonic acid | 0.1% |

This polymer had a kinematic molecular weight value of 40,000. The fusion melt was spun through a spinnerette plate having the following characteristics:

| | |
|---|---|
| Capillary Diameter | 120 microns |
| Capillary spacing, center to center | 1.3 millimeters |
| Counterbore Diameter | 1.2 millimeters |
| Counterbore spacing center to center | 1.2 millimeters |
| Capillary Density | 54 per square Centimeter |

The extrusion temperature was 170° C. and extrusion was directly into a steam-pressurized solidification zone maintained at 13 pounds per square inch gauge. The extrudates were stretched at a stretch ratio of 4.2 in a first stage and 9.8 in a second stage, dried at 138° C. and steam relaxed at 116° C. No filament breakage or sticking occurred. The fiber obtained had the following properties:

| | |
|---|---|
| Denier per filament | 3.15 |
| Straight tenacity | 3.2 grams/denier |
| Straight elongation | 30% |
| Loop tenacity | 2.6 grams/denier |
| Loop Elongation | 23% |

COMPARATIVE EXAMPLE A

Following the procedure of Example 1 in every material detail, an additional run was made using a polypropylene melt free of melt assistant and designated as fiber grade having a melt index of 3 (Trademark Rexene PP-3153) in place of the fusion melt of example. Extrusion was conducted at 260°–280° C. directly into air. The extrudates stuck together as they emerged from the spinnerette and the desired individual filaments could not be obtained.

EXAMPLES 2–5

Again following the procedure of Example 1 in every material detail except for the spinnerette plate, a series of runs were made using spinnerettes of the characteristics given in Table I which also indicates the example number. In each instance, no filament breakage or sticking occurred and the fiber obtained had properties substantially similar to those of the fiber of Example 1.

TABLE I

| Example | Overall Plate Diam. mm | Capillary Diameter μ | Capillary Total No. | Capillary SPACING mm | Capillary DENSITY* NO./cm² | COUNTERBORES DIAM. mm | COUNTERBORES SPACING mm |
|---|---|---|---|---|---|---|---|
| 2 | 381 | 200 | 5016 | 2.2 | 18 | 1.8 | 2.2 |
| 3 | 279 | 120 | 9060 | 1.7 | 25 | 1.5 | 1.7 |
| 4 | 279 | 100 | 5016 | 2.2 | 18 | 2.0 | 2.2 |
| 5 | 76 | 85 | 2937 | 1.2 | 67 | 1.0 | 1.2 |
| 6 | 432 | 120 | 30000 | 1.3 | 54 | 1.2 | 1.3 |

*Spinnerette capillary density was calculated based on effective area of plate used (flange area not included).

EXAMPLE 7

The process of Example 1 was again repeated in every material detail except that the polymer employed was copolymer of 94% acrylonitrile and 6% methyl acrylate having a kinematic molecular weight of 48,000. No filament breakage or sticking occurred during extrusion and the fiber obtained had substantially the same properties as those of Example 1.

We claim:

1. A process for melt-spinning acrylonitrile polymer fiber which comprises providing a homogeneous melt of an acrylonitrile fiber-forming polymer of kinematic molecular weight in the range of about 30,000 to 60,000 and water at a temperature above the boiling point of water at atmospheric pressure and at a temperature and pressure which maintains water in single phase with said polymer and extruding said fusion melt through a spinnerette assembly containing a spinnerette plate having a density of orifices of a diameter of about 60 to 160 microns of at least about 25 per square centimeter directly into a steam-pressurized solidification zone maintained under conditions such that the rate of release of water from the nascent extrudate avoids deformation thereof.

2. The process of claim 1 wherein said spinnerette plate has a density of orifices of at least about 60 per square centimeter.

3. The process of claim 1 wherein said orifice diameter is 85 microns.

* * * * *